US008201706B2

(12) United States Patent
Dembowiak et al.

(10) Patent No.: US 8,201,706 B2
(45) Date of Patent: Jun. 19, 2012

(54) CAN COVER AND METHOD

(75) Inventors: Casey M. Dembowiak, Greenfield, WI (US); Edmund A. Malczewski, Milwaukee, WI (US)

(73) Assignee: Riverwest Engineering & Design, Inc., West Allis, WI (US)

( * ) Notice: Subject to any disclaimer, the term of this patent is extended or adjusted under 35 U.S.C. 154(b) by 175 days.

(21) Appl. No.: 12/562,663

(22) Filed: Sep. 18, 2009

(65) Prior Publication Data

US 2010/0065573 A1 Mar. 18, 2010

Related U.S. Application Data

(60) Provisional application No. 61/098,096, filed on Sep. 18, 2008.

(51) Int. Cl.
*B65D 1/40* (2006.01)
*B65D 3/28* (2006.01)

(52) U.S. Cl. ..... 220/730; 220/729

(58) Field of Classification Search ..... 220/62, 220/694, 729, 730; 206/145, 147, 152, 217, 206/831

See application file for complete search history.

(56) References Cited

U.S. PATENT DOCUMENTS

| | | | | |
|---|---|---|---|---|
| 2,804,201 | A * | 8/1957 | Chappell | 206/232 |
| 4,852,763 | A * | 8/1989 | Dimberio | 220/253 |
| 5,720,412 | A * | 2/1998 | Ficken | 220/703 |
| 5,845,801 | A | 12/1998 | Heitl | |
| 5,887,742 | A * | 3/1999 | Lewis | 220/253 |
| 6,290,084 | B1 * | 9/2001 | Louie | 220/254.4 |
| 7,222,746 | B2 | 5/2007 | Eckstrum | |
| 7,475,787 | B2 * | 1/2009 | Gruver et al. | 220/258.2 |
| 2001/0040163 | A1 * | 11/2001 | Song | 220/258 |
| 2003/0168457 | A1 * | 9/2003 | Wang | 220/258.2 |
| 2005/0230402 | A1 * | 10/2005 | Greenberg | 220/705 |
| 2007/0075089 | A1 * | 4/2007 | Stein | 220/703 |

* cited by examiner

*Primary Examiner* — Harry Grosso
(74) *Attorney, Agent, or Firm* — Boyle Fredrickson, S.C.

(57) ABSTRACT

A can cover and method are provided for preventing debris from entering an opening in a lid of a pop-top can. The pop-top can includes an upper rim extending about the lid and a pivotable pop-top operatively connected to the lid. The can cover includes a generally flat sheet and a disc removably connected to the sheet. The disc includes a first side, a second side and an opening therethrough. Indicia is provided on the first side of the disc. The disc is receivable on the pop-top can such that the second side engages the rim of the pop-top can and the pop-top extends through the opening in the disc.

7 Claims, 2 Drawing Sheets

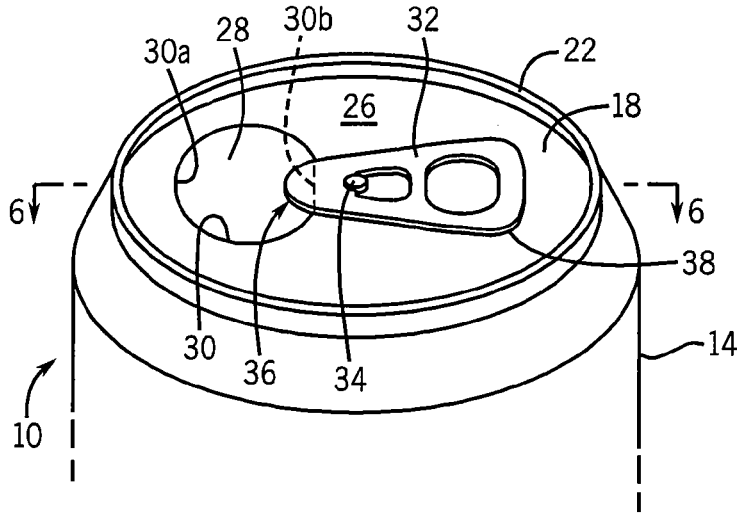
FIG. 5
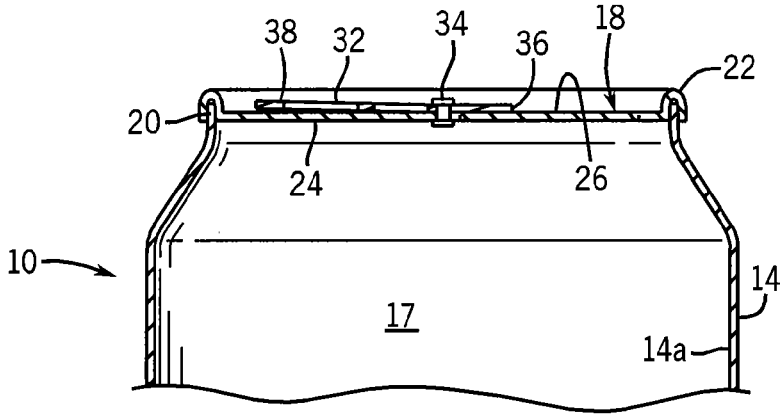
FIG. 6
FIG. 7
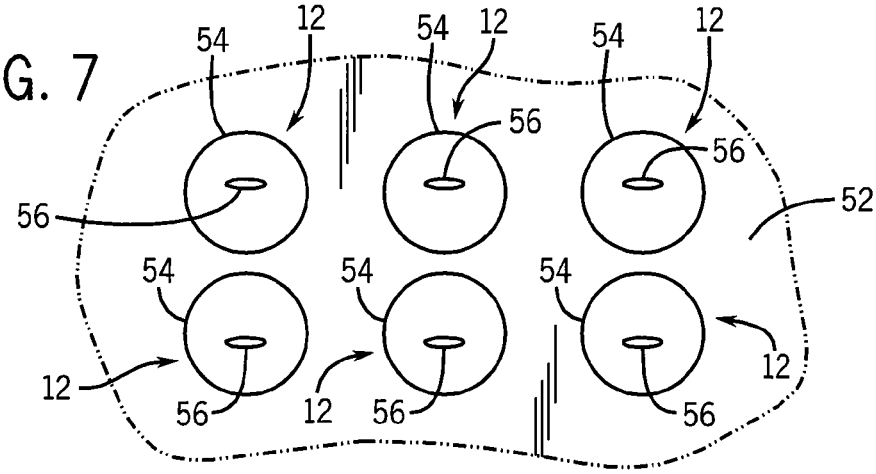

CAN COVER AND METHOD

CROSS-REFERENCE TO RELATED APPLICATIONS

This application claims priority to U.S. provisional application Ser. No. 61/098,096, filed Sep. 18, 2008, the entire contents of which is incorporated herein by reference.

FIELD OF THE INVENTION

This invention relates generally to beverage cans, and in particular, to a disposable can cover and method for preventing loose particles or flying insects from entering into the beverage can through an opening therein.

BACKGROUND OF THE INVENTION

As is known, many beverages are sold in beverage cans that utilize pop-top openers. Typically, pop-top openers are secured to the top surface of the beverage container by a rivet or the like at a location adjacent a frangible push-in closure. As the pop-top opener is lifted by a user, the nose portion of the opener engages the frangible push-in closure causing the closure to fracture at its outer periphery. The nose portion of the opener urges the fractured closure downwardly into the interior of the beverage container so as to allow a user access to the beverage or other liquid contained therein. It can be appreciated that with the beverage can opened, foreign particles such as dirt, dust or the like may inadvertently enter the beverage can. Alternatively, insects, such as bees or wasps, may be attracted to the contents of the beverage since such insects are often attracted to the sugars found in such beverages. As is known, these insects may bite or sting an unsuspecting individual attempting to take a sip from the beverage can.

Heretofore, numerous devices have been developed to prevent loose particles or flying insects from entering into an opened beverage can. By way of example, Eckstrum, U.S. Pat. No. 7,222,746 discloses a safety screen designed to be positioned within and attached to the underside of a lid of a beverage can about the outer periphery of the beverage opening. The screen is designed to prevent foreign objects, and in particular, stinging insects, such as bees and wasps, from entering into the beverage can. Similarly, Heidle, U.S. Pat. No. 5,845,801 discloses a safety shield for a pop-top beverage container that provides a barrier to foreign objects entering or exiting the container and that allows for the flow of liquid from the container. The shield is formed of resilient and flexible material that is positioned adjacent the inside of a shearable tab of a pop-top container and secured thereto. When the shearable tab of the pop-top is displaced inward into the container, the shield deflects inward to permit the tab to pivot therepast. Thereafter, the shield resiliently repositions itself so as to form a liquid traversable barrier positioned in the opening created by displacement of the shearable tab.

While functional for their intended purpose, these prior safety devices are difficult and expensive to implement. In addition, these prior devices require changes to the manufacturing processes for the beverage cans. Consequently, there exists an unresolved need for a simple and inexpensive can cover to prevent loose particles and/or flying insects from entering into the interior of an opened beverage can.

Therefore, it is a primary object and feature of the present invention to provide a disposable can cover and method for preventing loose particles or flying insects from entering into the beverage can through an opening therein.

It is a further object and feature of the present invention to provide a disposable can cover and method for preventing loose particles or flying insects from entering into the beverage can through an opening therein that is simple to use and inexpensive to manufacture.

In accordance with the present invention, a can cover is provided for preventing debris from entering an opening in a lid of a pop-top can. The pop-top can includes an upper rim extending about the lid and a pivotable pop-top operatively connected to the lid. The can cover includes a disc having an outer periphery, a first side, a second side and an opening therethrough. The disc is movable between a first disengaged position and a second engaged position. Indicia is provide on the first side of the disc. With the disc in the engaged position, the second side engages the rim of the pop-top can and the pop-top extends through the opening in the disc.

The diameter of the disc is greater than the diameter of the lid of the pop-top can, and the opening through the disc has a generally oblong configuration. The first side and the second side of the disc are generally flat. The disc has a generally circular configuration and the outer periphery of the disc extends beyond the rim of the pop-top can with the disc in the engaged position.

In accordance with a further aspect of the present invention, a can cover is provided for preventing debris from entering an opening in a lid of a pop-top can. The pop-top can includes an upper rim extending about the lid and a pivotable pop-top operatively connected to the lid. The can cover includes a generally flat sheet and a disc removably connected to the sheet. The disc includes a first side, a second side and an opening therethrough. Indicia is provided on the first side of the disc. The disc is receivable on the pop-top can such that the second side engages the rim of the pop-top can and the pop-top extends through the opening in the disc.

The diameter of the disc is than the diameter of the lid of the pop-top can and the opening through the disc has a generally oblong configuration. The first and second sides of the disc are generally flat and the disc has a generally circular configuration. The outer periphery of the disc extends beyond the rim of the pop-top can with the disc received thereon.

In accordance with a still further aspect of the present invention, a method of preventing debris from entering an opening of a pop-top can is provided. The pop-top can includes a pivotable pop-top. The method includes the step of providing at least one disc in a wall of a packaging container. The packaging container holds a plurality of beverage containers therein. The at least one disc is removed from the packaging container and a first end of the pop-top of the pop top can is inserted through an opening in a first disc of the at least one disc so as to retain the first disc on the pop-top can. The first disc overlaps the opening in the pop-top can.

Perforations are cut about outer peripheries of the at least one disc and indicia is printed on first sides of the at least one disc. The first disc has a diameter greater than a diameter of a lid of the pop-top can and the opening through the first disc has a generally oblong configuration. The first disc has a generally circular configuration and an outer periphery that extends beyond a rim of the pop-top can with the first end of the pop-top of the pop top can extending through the opening in the first disc.

BRIEF DESCRIPTION OF THE DRAWINGS

The drawings furnished herewith illustrate a preferred construction of the present invention in which the above advantages and features are clearly disclosed as well as other which will be readily understood from the following description of the illustrated embodiment.

In the drawings:

FIG. 5 is an isometric view of a lid of a conventional beverage can;

FIG. 6 is a cross sectional view of the lid taken along line 6-6 of FIG. 5; and FIG. 7 is a plan view of a beverage carton incorporating a plurality of can covers in accordance with the present invention.

DETAILED DESCRIPTION OF THE DRAWINGS

Figure 1:
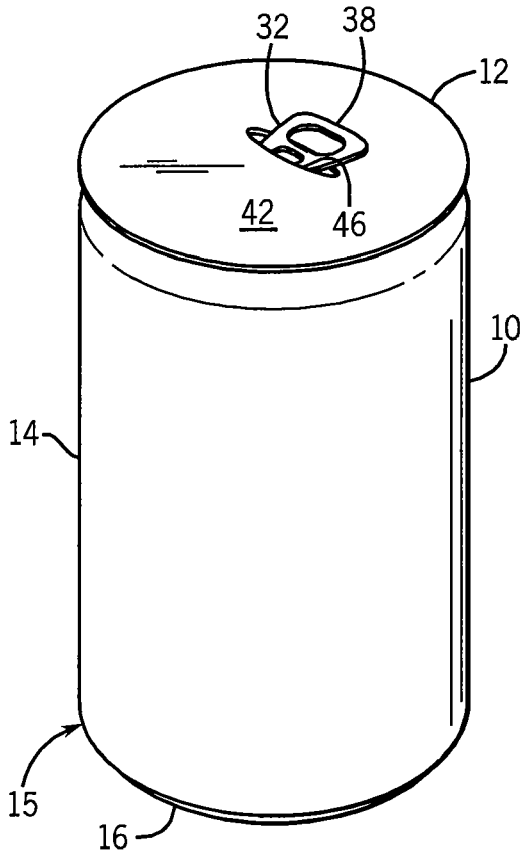
FIG. 1 is an isometric view of a beverage can having a can cover in accordance with the present invention positioned thereon.

Referring to FIG. 1, a standard beverage container is generally designated by the reference numeral 10. It is intended for can cover 12 in accordance with the present invention to be mounted on beverage container 10, as hereinafter described. As best seen FIGS. 1-2 and 5-6, beverage container 10 includes a generally tubular sidewall 14 having an inner surface 14*a* defining cavity 17 for receiving a beverage, such as carbonated liquid, therein. The lower end 15 of sidewall 14 is closed by bottom wall 16. Bottom wall 16 of beverage container 10 includes an inwardly directed bulge (not shown) to counteract the pressure of the carbonated liquid received within beverage container 10. As is conventional, upper edge 20 of sidewall 14 is closed by lid 18 which, in turn, is secured to upper edge 20 of sidewall 14 by rim 22. Lid 18 includes lower surface 24 directed toward cavity 17 within the interior of beverage can 10 and an upper surface 26. A generally circular shearable tab 28 is formed in lid 18. Outer periphery 30 of shearable tab 28 includes a first shearable portion 30*a* having a reduced thickness, for reasons hereinafter described, and a second portion 30*b* fixed to lid 18. Beverage container 10 further includes a generally flat pop-top 32 interconnected to upper surface 26 of lid 18 by rivet 34 or the like. First end 36 of pop-top 32 defines a nose that overlaps shearable tab 28 of lid 18 and second end 38.

In order to open beverage container 10, second end 38 of pop-top 32 is lifted away from upper surface 26 of lid 18 so as to pivot pop-top 32 on rivet 34. As pop-top 32 pivots on rivet 34, nose 36 of pop-top 32 engages shearable tab 28 causing shearable tab 28 to break free from lid 18 along shearable portion 30*a* of the outer periphery 30 of shearable tab 28. Shearable tab 28 is urged downwardly and inwardly into the interior of beverage container 10 such that the shearable portion 30*a* of outer periphery 30 of shearable tab 28 defines an opening in lid 18.

Figure 2:
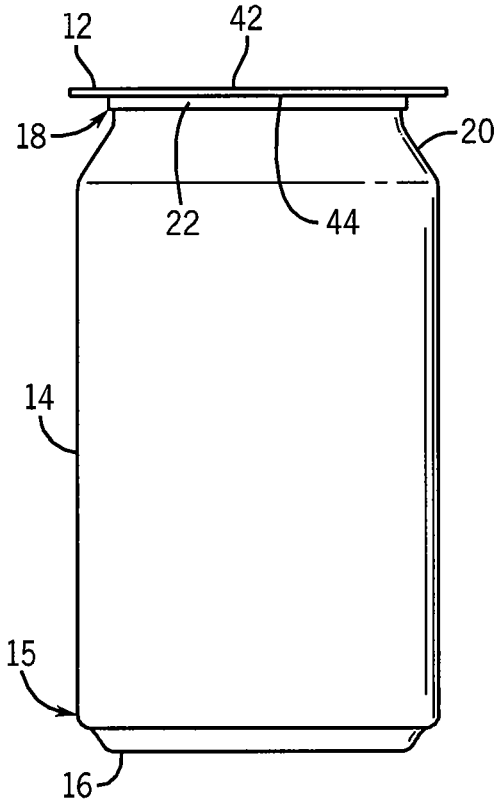
FIG. 2 is a side elevational view of a beverage can and can cover of FIG. 1.
Figure 3:
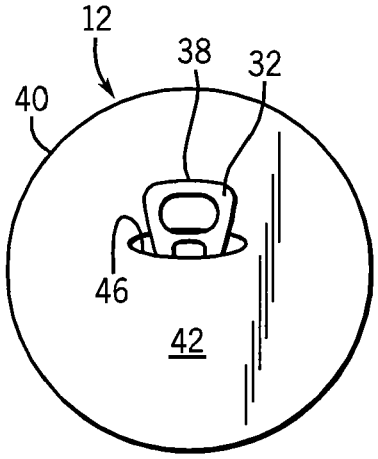
FIG. 3 is top plan view of the beverage can and can cover of FIG. 1.
Figure 4:
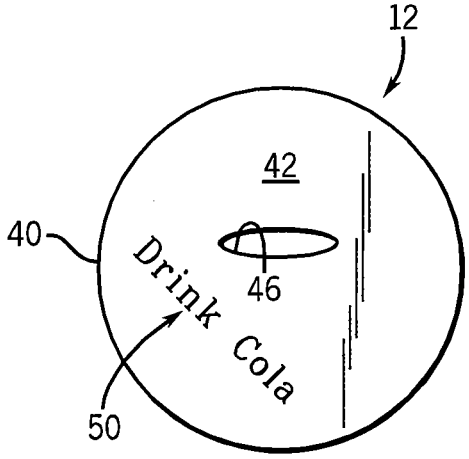
FIG. 4 is a top plan view of the can cover of the present invention.

Referring to FIGS. 2-4, cover can 12 of the present invention is generally disc shaped and includes an outer periphery 40. Can cover 12 is further defined by a generally flat upper surface 42 and a generally flat lower surface 44. While can cover 12 is shown having a generally circular configuration, it can be appreciated that other configurations are possible without deviating from the scope of the present invention. Can cover 12 further includes a generally oblong opening 46 therethrough. It is contemplated for oblong opening 46 to be generally centrally located from outer periphery 40 of can cover 12 and adapted for receiving second end 38 of pop top 32 therethrough.

As best seen in FIG. 1, in operation, once beverage container 10 has been opened as heretofore described, can cover 12 is positioned on lid 18 of beverage container 10 such that second end 38 of pop top 32 extends through oblong opening 46 through can cover 12. It is intended for second end 38 of pop top 32 to retain can cover 12 on lid 18. It is further intended for the outer periphery 40 of can cover 12 to project radially outward throughout rim 22. Once can cover 12 is positioned on beverage container 10, it can be appreciated that can cover 12 will prevent loose particles or flying insects from entering into cavity 17 within beverage container 10 through the opening defined by shearable portion 30*a* of outer periphery 30 of shearable tab 28.

Referring to FIG. 7, it is contemplated to form a plurality of can covers 12 within a sheet such as a wall[s] of a corrugated or cardboard box 52 used to package a plurality of beverage containers 10. More specifically, perforations or score lines 54 may be provided in the corrugated or cardboard packaging 52 that correspond to the outer peripheries 40 of can covers 12. In addition, score lines 56 may be provided in the corrugated or cardboard packaging 52 that correspond to the oblong openings 46 in can covers 12. Once the beverage containers 10 are removed from the corrugated or cardboard packaging 52, the user may simply punch out the can covers 12 along the score lines 54 and 56 provided in the corrugated or cardboard packaging 52. In addition, it is contemplated to provide indicia 50 such as advertising or sports team names on the upper surface 42 of can cover 12. This, in turn, increases the marketing potential associated with the packaging for the beverage container 10.

Various modes of carrying out the invention are contemplated as being within the scope of the following claims particularly pointing out and distinctly claiming the subject matter which is regarded as the invention.

We claim:

1. A method of preventing debris from entering an opening of a pop-top can, the pop-top can including a pivotable pop-top, comprising the steps of:

providing at least on disc in a wall of a packaging container, the packaging container for holding a plurality of beverage containers;

removing the at least one disc from the packaging container; and inserting a first end of the pop-top of the pop top can through an opening in a first disc of the at lest one disc so as to retain the first disc on the pop-top can; wherein the first disc overlaps the opening in the pop-top can.

2. The method of claim 1 comprising the additional step of cutting perforations about outer peripheries of the at least one disc.

3. The method of claim 1 comprising the additional step of printing indicia on first sides of the at least one disc.

4. The method of claim 1 wherein the first disc has a diameter greater than a diameter of a lid of the pop-top can.

5. The method of claim 1 wherein the opening through the first disc has a generally oblong configuration.

6. The method of claim 1 wherein the first disc has a generally circular configuration.

7. The method of claim 1 wherein the first disc has an outer periphery that extends beyond a rim of the pop-top can with the first end of the pop-top of the pop top can extending through the opening in the first disc.

* * * * *